United States Patent [19]

Connelly et al.

[11] Patent Number: 4,630,452

[45] Date of Patent: Dec. 23, 1986

[54] EARRING CLUTCH MECHANISM AND DETACHABLE LOAD DISTRIBUTION MEMBER FOR USE IN COMBINATION THEREWITH

[75] Inventors: Lynette M. Connelly, Staton Island; Norman Gatof, New York, both of N.Y.

[73] Assignee: Crystal Brands, Inc., New York, N.Y.

[21] Appl. No.: 745,468

[22] Filed: Jun. 17, 1985

[51] Int. Cl.[4] ..... A44C 7/00

[52] U.S. Cl. ..... 63/12; 16/2; 24/108; 24/155 R; 248/56; 248/634; 411/533; 63/14 B

[58] Field of Search ..... 63/12, 13, 29 R, 14 B; 248/27.1, 56, 105, 634; 411/531, 533, 371, 372; 16/2; 24/39 P, 108, 155 R, 155 SD

[56] References Cited

U.S. PATENT DOCUMENTS

| | | | |
|---|---|---|---|
| 686,068 | 11/1901 | Herrick et al. | 63/14 B |
| 2,666,973 | 1/1954 | Mosley | 63/14 B X |
| 2,763,999 | 9/1956 | Norman | 63/14 B |
| 3,067,974 | 12/1962 | Baldwin | 248/27.1 |
| 3,476,253 | 11/1969 | Fosler et al. | 248/634 X |
| 3,549,828 | 12/1970 | Lang | 248/27.1 |
| 3,563,056 | 2/1971 | Noel | 63/12 |
| 3,630,048 | 12/1971 | Masters | 63/12 |
| 3,698,044 | 10/1972 | Chernow | 24/108 |
| 3,725,980 | 4/1973 | Burgio | 24/108 |
| 3,845,961 | 11/1974 | Byrd | 248/56 |
| 4,136,598 | 1/1979 | Hughes | 411/372 |
| 4,195,492 | 4/1980 | Johnson | 63/29 R X |
| 4,353,225 | 10/1982 | Rogers | 63/29 R X |
| 4,361,997 | 12/1982 | De Caro | 411/533 |

FOREIGN PATENT DOCUMENTS

| | | | |
|---|---|---|---|
| 68130 | 10/1975 | Australia | 411/531 |
| 543394 | 2/1942 | United Kingdom | 248/27.1 |

OTHER PUBLICATIONS

Huntley, D. G., IBM Technical Disclosure Bulletin, vol. 26, No. 3A, Aug. 1983, "Fan Mounting Rings".

*Primary Examiner*—F. Barry Shay

*Attorney, Agent, or Firm*—L. MeRoy Lillehaugen

[57] ABSTRACT

A clutch mechanism for releasably gripping the pin or post of an earring has a circular end that normally confronts a person's ear lobe when the pin or post of the earring is engaged in the clutch mechanism. A load distribution member, preferably of vinyl, has a cylindrical sleeve formed with an inwardly directed lip at one end which expands sufficiently to allow the circular end of the clutch mechanism to be inserted into the interior of the cylindrical sleeve. The cylindrical sleeve has a substantially closed end wall at its other end, having a radially directed flange that provides, together with the end wall, a substantial increase in the surface area as contrasted to that provided only by the circular end of the clutch mechanism.

14 Claims, 4 Drawing Figures

EARRING CLUTCH MECHANISM AND DETACHABLE LOAD DISTRIBUTION MEMBER FOR USE IN COMBINATION THEREWITH

BACKGROUND OF THE INVENTION

1. Field of the Invention

This invention relates generally to earrings, and pertains more particularly to a load distribution member for attachment to an earring clutch mechanism.

2. Description of the Prior Art

Several different types of clutch mechanisms have been devised and patented for the purpose of releasably gripping the pin or post projecting from the ornamental part of the earring. One such clutch mechanism is disclosed in U.S. Pat. No. 3,698,044, granted on Oct. 17, 1972 to Michael Chernow for "Clutch Mechanism For Jewelry Pin." The present invention is especially intended for use in combination with the clutch mechanism of said patent. Although the patented clutch mechanism has performed quite well, the portion thereof that bears against a pierced ear lobe is of relatively small area. Hence, when an earring of sizable mass is to be used with such a clutch mechanism, certain difficulties have arisen.

SUMMARY OF THE INVENTION

Accordingly, a general object of my invention is to overcome the disadvantages experienced when using the alluded to type of clutch mechanism. In this regard, an aim of the present invention is to substantially increase the lobe-contacting area over and above that provided by only the clutch mechanism itself.

More specifically, an object of the present invention is to, for all intents and purposes, obviate the discomfort that has attended the use of a clutch mechanism of the type just referred to, my invention possessing especial utility when relatively large and massive earrings are attached to a pierced ear lobe. Where the mass of the earring is quite substantial, and the area of the clutch mechanism that engages the ear lobe is relatively small, then a concentrated and objectionable amount of force is applied to the ear lobe. By distributing the force or load so that the actual pressure per unit area is reduced, the wearer's comfort is increased.

Also, the invention has for an object to cause earrings, both small and large, to hang properly so as to not detract from their appearance. For instance, when a pendant-type of earring is used, the pin or post extending through the pierced ear lobe should be substantially horizontal so that the member from which the pendant depends is also maintained in a generally horizontal relationship. In this way, the dangling pendant will maintain a substantially perpendicular relation with respect to the member from which it hangs and relative to the pin or post gripped by the clutch mechanism.

Yet another object of the invention is to provide a load distribution member that will be inconspicuous. In this regard, an aim of the invention is to provide a useful accessory for a clutch mechanism that can be made of translucent, or even clear, plastic, such as vinyl.

A further object of the invention is to provide a load distribution member for earrings that can be used without difficulty. More specifically, an aim of the invention is to provide a load distribution member that can be easily attached and detached from a conventional clutch mechanism. When attached, then the load distribution member and the clutch mechanism constitute a single unit and can be readily manipulated as such. Consequently, it is within the purview of the present invention to integrate the load distribution member with the clutch mechanism so that the two are conveniently handled in the same manner as the clutch mechanism alone in attaching and detaching the earring from a pierced ear lobe.

Still further, an object of the present invention is to provide a load distribution member that is not only inconspicuous when worn, but of such small size that a pair of such members can be carried about in one's purse when not needed.

The invention also has for an object the provision of a load distribution member that is exceedingly lightweight, thereby further contributing to the comfort that has already been mentioned.

The invention has for still an additional object the provision of a member of the character described above that will be very inexpensive to manufacture, thereby encouraging its widespread purchase and use.

Briefly, my invention envisages an ornamental earring having a pin or post projecting therefrom, the post or pin being designed to pass through a pierced ear lobe. Clutch mechanisms of the type hereinbefore referred to, while satisfactory for the releasable gripping of pins or posts on ornamental earrings of fairly small mass, are not completely adequate for more massive ornamental earrings. Thus, the load distribution member that constitutes my invention involves a resilient sleeve having an inwardly directed lip at its open end so that the end of the clutch mechanism with which the load distribution member is to be used can be snapped over the end of the clutch mechanism so as to releasably retain the sleeve on the clutch mechanism. The sleeve has a substantially closed end opposite its open end, the closed end having a relatively small aperture that is automatically aligned with the two apertures of the clutch mechanism when the sleeve telescopically receives therein the end portion of the clutch mechanism. A flange extends radially outward from the closed end of the sleeve so that the flange, together with the apertured end wall, will confront or engage the ear lobe instead of the clutch mechanism which normally engages the ear lobe. In other words, the load distribution member, when connected to the clutch mechanism, provides a much greater surface that actually contacts the ear lobe than that heretofore provided by just the clutch mechanism, thereby decreasing the pressure in that the load is spread over a larger surface area of the ear lobe.

BRIEF DESCRIPTION OF THE DRAWING

FIG. 2 is a perspective view taken in an opposite direction from that in which FIG. 1 is taken so as to expose my invention;

DESCRIPTION OF THE PREFERRED EMBODIMENT

Figure 1:
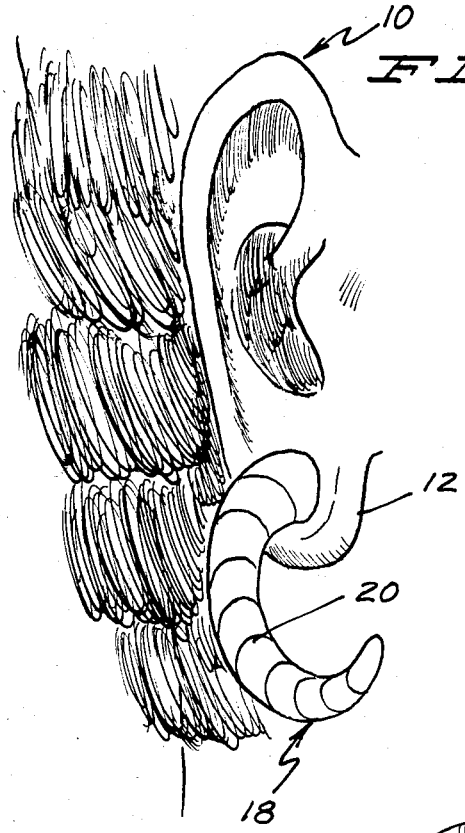
FIG. 1 is perspective view of a person's ear with an ornamental earring suspended therefrom, my invention, however, being on the opposite side of the ear and hence concealed by the ear.
Figure 2:
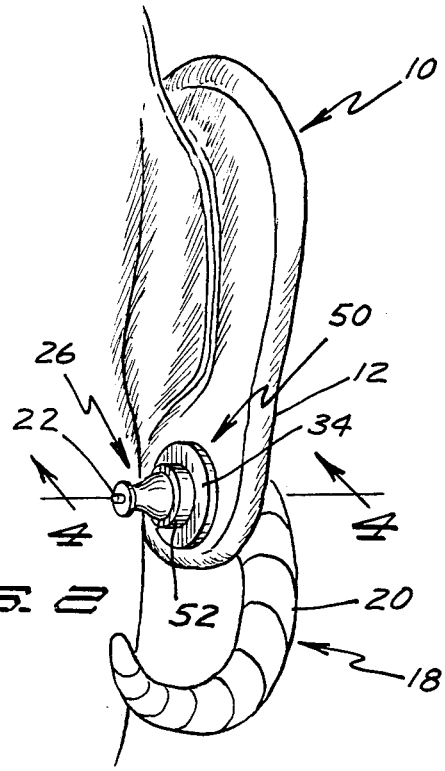
Figure 3:
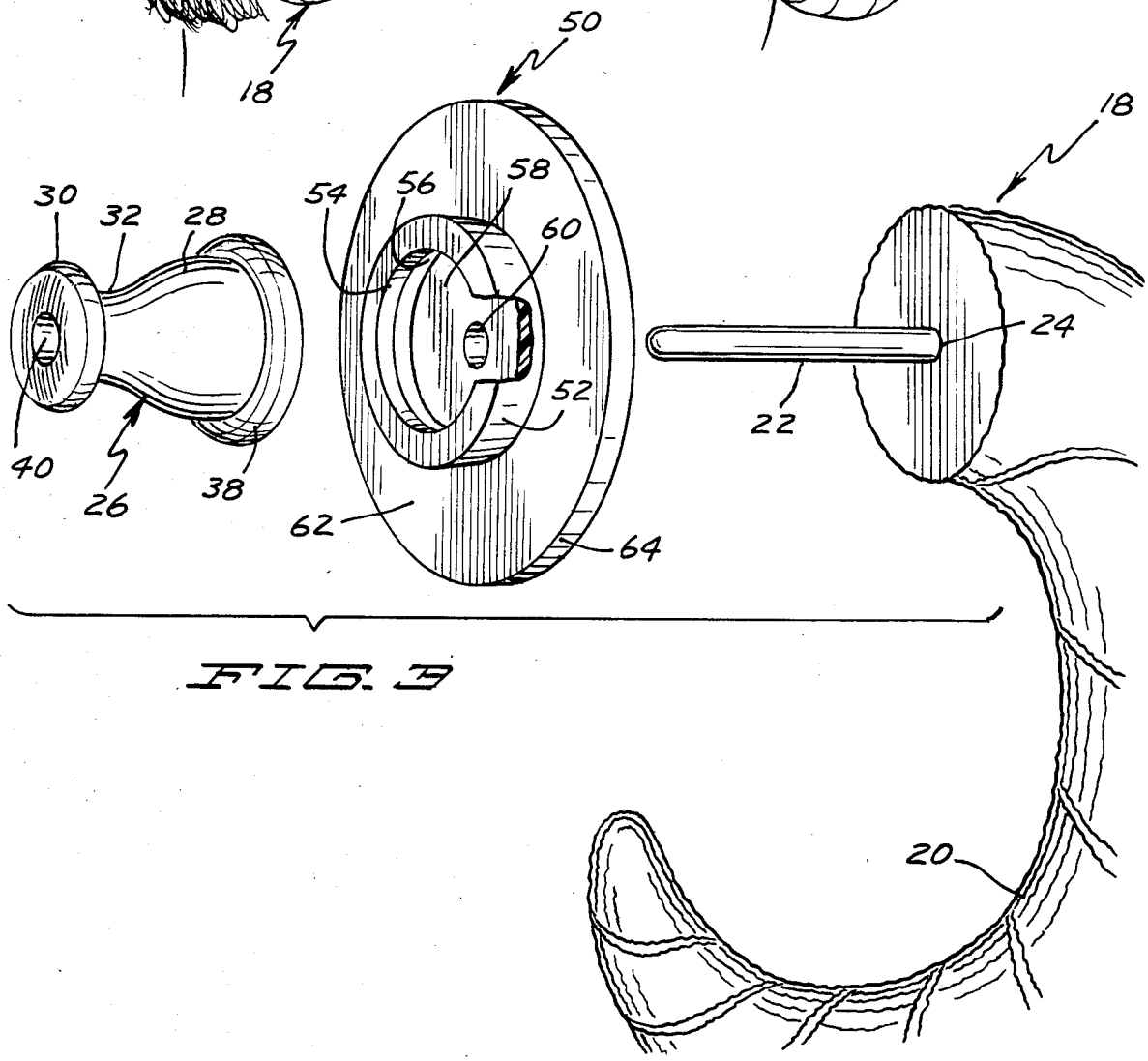
FIG. 3 is an exploded perspective view of the ornamental member with its integral pin or post, the clutch mechanism and my load distribution member therebetween, a portion of the member having been broken away and the ear lobe omitted for reasons of clarity.
Figure 4:
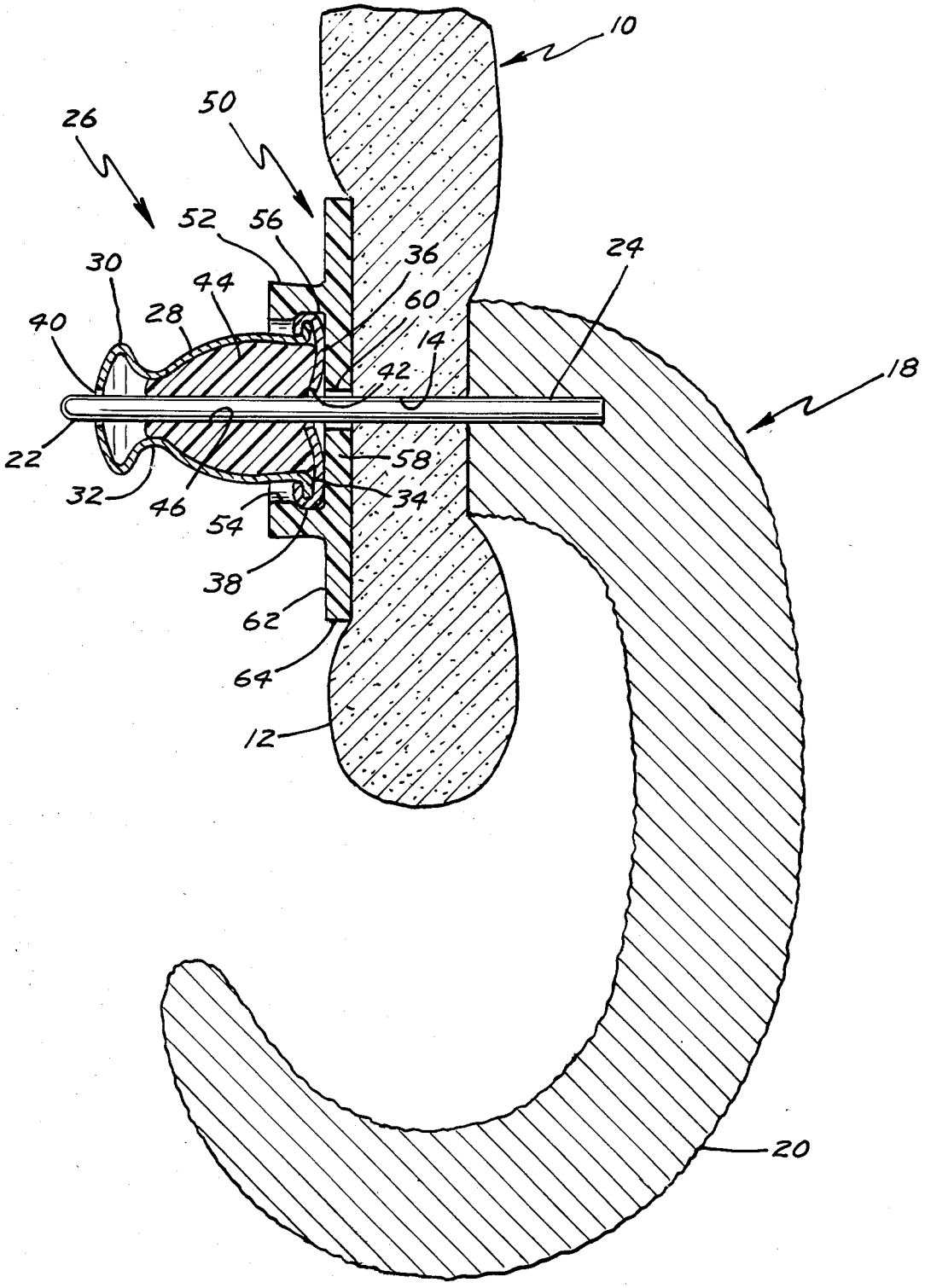
FIG. 4 is a greatly enlarged sectional view taken in the direction of 4—4 of FIG. 2.

In order to illustrate my invention, a person's ear 10 has been shown in FIGS. 1, 2 and 4, the ear 10 having an ear lobe 12 that has been pierced to provide a passage 14 (FIG. 4).

The earring itself has been assigned the reference numeral 18, being comprised of an ornamental or decorative element 20 having an end portion of a conventional pin or post 22 anchored therein at 24. Quite obviously, the earring 18 can assume a variety of different configurations. For instance, the element 20, which is somewhat C-shaped, could have a depending pendant member dangling therefrom. As the description progresses, it will be recognized that the more sizable or massive the earring 18 is, the more severe the problems become.

Inasmuch as the clutch mechanism denoted generally by the reference numeral 26 is fully described in the aforesaid Chernow patent, only a brief description thereof will herein be given. In this regard, the clutch mechanism 26 includes a thin metal housing 28 provided with a knob or head 30 at one end. The housing 28 is necked in at 32 so that the housing 28 can be conveniently grasped between a person's fingers.

In order to properly understand the present invention, it should be recognized that the end of the mechanism 26 opposite the end having the knob 30 thereon has a circular configuration. Providing the circular configuration is an outwardly directed flange 34 integral with the housing 28, and a metal cap 36 having a rolled edge 38 that overlies the outer edge of the flange 34 to provide a rounded cross section, as is clearly visible in FIG. 4.

There is an aperture or opening 40 at the head end of the housing 28 and a second aperture or opening 42 at the circular end thereof. Contained within the housing 28 is a resilient insert 44 having a longitudinal bore 46 extending therethrough, the bore 46 having a cross section slightly less than that of the pin or post 22. The material constituting the insert 44 is preferably of polyethylene. It will be appreciated that the pin or post 22 is resiliently gripped by the insert 44 when the pin or post 22 is introduced first through the opening or aperture 42, then through the bore 46 and finally through the other aperture 40, all as clearly depicted in FIG. 4.

Playing a very important role in the practicing of my invention is a load distribution member denoted generally by the reference numeral 50. Here again, the material is susceptible to variation, but it is planned that the member 50 be fabricated from vinyl plastic, vinyl having resilient and yieldable characteristics particularly suitable for use in the situation now to be described.

The load distribution member 50 includes a cylindrical sleeve 52. The cylindrical sleeve 52 has an open end about which extends an inwardly directed lip 54 forming an internal annular groove at 56. The lip 54 has an internal diameter approximately 0.002 inch less than the outside diameter of the rolled edge 38 belonging to the metal cap 36. In this way, a snap fit is provided when the clutch mechanism 26, more specifically its rolled edge 38 constituting its circular end, is forced into the annular groove 56, the lip 54 flexing and expanding radially outwardly to such an extent that the rolled edge 38 passes thereby to enter the relatively shallow groove 56.

The cylindrical sleeve 52 has an end wall 58 against which the cap 36 abuts when fully pressed into the annular groove 56 in the sleeve 52. However, there is a centrally disposed aperture or opening 60 in the end wall 58 which enables the pin or post 22 to pass therethrough when it is being inserted into the clutch mechanism 26. In other words, the pin or post 22 is first threaded through the aperture 60 and then successively through the apertures 42 and 40 of the housing 28.

The load distribution member 50 additionally includes a radially directed flange 62 having a circular outer edge 64. It will be appreciated that the cylindrical sleeve 52 and the flange 62, as well as the lip 54, are all molded as one piece. Thus, the cylindrical sleeve 52 is concentrically disposed with respect to the circular edge 64 of the flange 62, and the aperture or opening 60 is concentrically disposed relative to the sleeve 52.

In use, it will be appreciated that one only has to gently press the cap 36, more specifically its rounded or rolled edge 38, in the direction of the inwardly directed lip 54, the lip 54 yielding sufficiently so that the circular end having the rolled edge 38 thereon passes the inwardly directed lip 54, abutting the end wall 58 when fully engaged in the annular groove 56. It will be understood that the lip 54 provides the annular groove 56 that receives the rolled edge 38 therein. The dimensions of the member 50 are correlated with those of the rolled edge 38 so that the rolled edge is snugly but releasably held once it is fully received in the annular groove 56. The rolled edge 38, which has a rounded cross section as can be discerned from FIG. 4, serves as a camming surface for the cap 36 as the clutch mechanism 26 is forced into sleeve 52. By the same token, when the clutch mechanism 26 is to be removed, then the other side of the rolled edge 38 serves as a camming surface against the inwardly extending lip 54 to permit facile detachment of the clutch mechanism 26 from the load distribution member 50.

While precise dimensions are not critical to the practicing of my invention, nonetheless it should be made clear that the right side or face of the member 50 provides a considerable surface area that confronts the inner side of the ear lobe 12. In other words, the right side of the closed end 58, as viewed in FIG. 4, is co-planar with the right side of the flange 62.

As an example, it can be assumed that the rolled edge 38 belonging to the cap 36 has a diameter of 0.2 inch and the diameter of the circular edge 64 has a diameter of 0.5 inch. With such dimensions, which have been incorporated in commercial embodiments of the clutch mechanism 26 and the load distribution member 50, it follows that the lobe-contacting surface of the member 50 is slightly over six times that of only the cap 36. Obviously, for a relatively heavy and massive earring 18, the drammatic increase in surface area is extremely beneficial in lessening or reducing the pressure or load against the ear lobe 12. Not only that, but any tendency for the earring 18 to cock or skew is minimized because of the increased contact area provided by the member 50. It is important to bear in mind, though, that the member 50 can be readily removed from the clutch mechanism 26 whenever a lesser massiveness of the earring 18 makes it such that the added surface area is not needed. Yet, owing to the relatively small size of the member 50, a pair can be carried readily in one's purse for use whenever earrings of such a size warrant the use of the member 50 in combination with a clutch mechanism 26. Stated somewhat differently, the member 50 functions as an accessory, being available for use when circumstances so dictate and being readily removed when the extra surface contact is not needed. The member 50, however, is quite inconspicuous when attached to the clutch mechanism 26 and used behind a person's ear, as can be appreciated from FIG. 2.

We claim:

1. For use with an earring clutch mechanism, a detachable load distribution member comprising a resilient cylindrical sleeve having inner and outer surfaces of generally uniform diameter, for receiving one end of said clutch mechanism, said sleeve having first and second ends, a flange extending outwardly a substantial distance from said sleeve and surrounding said sleeve at said first end thereof, for confronting a greater surface portion of a pierced ear lobe than would be confronted by only said one end of said clutch mechanism, and a resilient lip extending inwardly a preferred distance from said sleeve at said second end thereof for releasably retaining said one end of said clutch mechanism within said sleeve, said lip at least partially surrounding the inner surface of said sleve, the substantial distance said flange extends outwardly from said first end of said sleeve being appreciably greater than the preferred distance said lip extends inwardly from said second end of said sleeve.

2. The load distribution member of claim 1 including an end wall at said first end of said sleeve, one side of said end wall being co-planar with one side of said flange.

3. The load distribution member of claim 2 in which said end wall has an aperture concentrically disposed in relation to said cylindrical sleeve.

4. The load distribution member of claim 1 in which said flange has a circular outer edge, said cylindrical sleeve being concentric with said outer edge.

5. In combination, an earring clutch mechanism comprising a housing and having a circular end, and a load distribution member comprising a sleeve of resilient plastic having a cylindrical interior surface forming the longitudinal passage of the sleeve, in which said circular end is adapted to be received in a close fit therewith, means at one end of said sleeve for removably retaining said circular end in said cylindrical interior, and a flange at the other end of said sleeve having an outwardly facing surface which extends radially and perpendicularly outwardly a considerable distance from said sleeve to provide a substantially greater surface at said other end of said sleeve than at said one end of said sleeve.

6. In combination, an earring clutch mechanism comprising a housing and having a circular end, and a load distribution member comprising an interiorly cylindrical sleeve of resilient plastic in which said circular end is received in a close fit therewith, a flange extending radially outwardly and perpendicularly from said cylindrical sleeve at one end thereof, an end wall extending radially inwardly from said flange at said one end of said cylindrical sleeve, said flange and said end wall having coplanar surfaces, and means for detachably retaining said load distribution member on said clutch mechanism including an inwardly extending lip at the other end of said sleeve, said lip having an internal diameter slightly less than the outer diameter of the circular end of said mechanism and in which the circular end of said mechanism has a rounded cross section so that said lip is cammed radially outward when said circular end is manually inserted into said sleeve to be placed in contact with said end wall.

7. The combination of claim 6 in which said lip forms an annular recess for receiving said circular end when said circular end is fully received in said sleeve, said circular end then abutting said end wall.

8. In combination, an earring clutch mechanism and a detachable load distribution member comprising a sleeve having first and second ends, an annular flange at said first end of said sleeve, said flange having a peripheral edge spaced a substantial distance outwardly from said first end of said sleeve and said flange having generally oppositely directed surfaces extending outwardly from said first end of said sleeve to said peripheral edge, one of said surfaces facing toward said second end of said sleeve and the other of said surfaces being in a plane generally perpendicular to the long axis of said sleeve and facing away from said second end, said substantial distance being sufficiently great in relation to the cross section of said sleeve so that said other surface is capable of confronting a greater surface portion of a pierced ear than would be confronted by said clutch mechanism, and means at said second end of said sleeve for releasably retaining an end portion of said clutch mechanism within said second end of said sleeve, said sleeve including means for preventing said clutch mechanism from moving beyond said first end.

9. The load distribution member of claim 8 in which said means includes an inwardly directed resilient lip.

10. In combination, an earring clutch mechanism comprising a housing and having a circular end, and a load distribution member comprisng a sleeve of resilient plastic having a cylindrical interior in which said circular end is adapted to be received in a close fit therewith, means at one end of said sleeve for removably retaining said circular end in said cylindrical interior, a flange extending radially and perpendicularly outwardly from said sleeve at the other end of said sleeve, and an end wall extending radially inwardly from said flange at said other end of said sleeve, said end wall being positioned to be abutted by said circular end when said circular end is retained in said cylindrical interior, said flange and said end wall having coplanar surfaces.

11. The combination of claim 10 in which said removably retaining means includes an inwardly extending lip at the other end of said sleeve, said lip having an internal diameter slightly less than the outer diameter of the circular end of said housing.

12. The combination of claim 10 in which said mechanism and end wall have aligned apertures for the accomodation of the post of the earring.

13. For use with an earring clutch mechanism, a detachable load distribution member comprising a sleeve having first and second ends, an annular flange at said first end of said sleeve, said flange having a peripheral edge spaced a substantial distance outwardly from said first end of said sleeve and said flange having generally oppositely directed surfaces extending outwardly from said first end of said sleeve to said peripheral edge, one of said surfaces facing toward said second end of said sleeve and the other of said surfaces being in a plane generally perpendicular to the long axis of said sleeve and facing away from said second end for confronting a greater surface portion of a pierced ear than would be confronted by said clutch mechanism, means at said second end of said sleeve for releasably retaining an end portion of said clutch mechanism within said second end of said sleeve, said releasably retaining means including an inwardly directed resilient lip, and an interiorly disposed annular wall at said first end of said sleeve having a first surface for abutting relationship with the end of said clutch mechanism when the latter is in said sleeve second end and having a second flat surface residing in the same plane as said second surface of said flange.

14. The load distribution member of claim 13 in which said wall has a centrally disposed aperture for accommodating a post on said clutch mechanism.

* * * * *